US010522094B1

(12) United States Patent
Richards et al.

(10) Patent No.: US 10,522,094 B1
(45) **Date of Patent: *Dec. 31, 2019**

(54) GLOBAL ILLUMINATION MODE LIQUID CRYSTAL DISPLAY FOR VIRTUAL REALITY

(71) Applicant: Facebook Technologies, LLC, Menlo Park, CA (US)

(72) Inventors: Evan M. Richards, Fremont, CA (US); Nirav Rajendra Patel, San Francisco, CA (US); Jianru Shi, Union City, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/431,623

(22) Filed: Jun. 4, 2019

Related U.S. Application Data

(63) Continuation of application No. 15/475,820, filed on Mar. 31, 2017, now Pat. No. 10,360,857.

(60) Provisional application No. 62/317,380, filed on Apr. 1, 2016, provisional application No. 62/326,286, filed on Apr. 22, 2016.

(51) Int. Cl.
*G09G 3/34* (2006.01)

(52) U.S. Cl.
CPC ... *G09G 3/3406* (2013.01); *G09G 2320/0646* (2013.01); *G09G 2320/106* (2013.01); *G09G 2350/00* (2013.01); *G09G 2370/022* (2013.01)

(58) Field of Classification Search
None
See application file for complete search history.

(56) References Cited

U.S. PATENT DOCUMENTS

2010/0156964 A1* 6/2010 Masuda ..... G09G 3/342 345/691
2014/0015742 A1* 1/2014 Yamaguchi ..... G06F 3/0412 345/102

* cited by examiner

*Primary Examiner* — Kenneth B Lee, Jr.
(74) *Attorney, Agent, or Firm* — Fenwick & West LLP

(57) ABSTRACT

Disclosed is a liquid crystal display device comprising a liquid crystal layer including a plurality of liquid crystals in a pixel area and a backlight unit coupled to the liquid crystal layer. A plurality of pixels are disposed in the pixel area. The backlight unit is configured to project light towards the entire pixel area of the liquid crystal layer during an illumination time period of a frame time, and not to project the light towards any of the pixel area of the liquid crystal layer during a non-illumination time period of the frame time. By enabling the backlight unit for the illumination time period less than the frame time, image streaking and latency can be reduced.

20 Claims, 5 Drawing Sheets

GLOBAL ILLUMINATION MODE LIQUID CRYSTAL DISPLAY FOR VIRTUAL REALITY

CROSS-REFERENCE TO RELATED APPLICATIONS

This application is a continuation of U.S. application Ser. No. 15/475,820, filed Mar. 31, 2017, which claims priority to and the benefit of U.S. Provisional Patent Application No. 62/317,380 filed on Apr. 1, 2016, and U.S. Provisional Patent Application No. 62/326,286 filed on Apr. 22, 2016, all of which are incorporated herein by reference in their entirety.

FIELD

The present disclosure generally relates to enhancing a Liquid Crystal Display (LCD) for use in a virtual reality, mixed reality, or augmented reality system.

BACKGROUND

Developments in a flat screen display technology have prompted proliferation of various electronic devices. Among various types of flat screen displays, an LCD is widely used in different electronic devices. An LCD includes a backlight unit (BLU) and a liquid crystal (LC) layer disposed on the backlight unit. Typically, the BLU constantly projects light towards the LC layer, and the LC layer including a plurality of LCs controls an amount of the light passing through according to states of the plurality of LCs. A simple architecture of the LCD allows a flat screen to be implemented in low cost.

However, the LCD suffers from a few drawbacks. In one example, changing states of the LCs may take several milliseconds (ms), thereby limiting a response time of the LCD or preventing an increase in the frame rate (e.g., 90 Hz or higher). For virtual reality (VR) or augmented reality (AR) applications, images are generated according to a user's movement, and a slow response time may be noticed as latency or a lag. Moreover, continuously projected light from the BLU may cause a motion blur or image streaking, when images are displayed with a fast frame rate.

SUMMARY

Disclosed embodiments include a liquid crystal display device comprising a liquid crystal layer and a backlight unit coupled to the liquid crystal layer. The liquid crystal layer includes a plurality of liquid crystals in a pixel area. A plurality of pixels are disposed in the pixel area. The backlight unit is configured to project light towards the entire pixel area of the liquid crystal layer during an illumination time period of a frame time, and not to project the light towards any of the pixel area of the liquid crystal layer during a non-illumination time period of the frame time.

In one or more embodiments, a first set of pixels of the plurality of pixels in a first row is applied with a liquid crystal control signal during a first portion of the non-illumination time period. States of liquid crystals corresponding to the first set of pixels may be changed during a second portion of the non-illumination time period after the first portion of the non-illumination time period. The states of the liquid crystals corresponding to the first set of pixels may be changed during the second portion of the non-illumination time period, while a second set of pixels of the plurality of pixels in a second row is applied with the liquid crystal control signal.

In one or more embodiments, the backlight unit projects the light towards the first set of pixels and the second set of pixels simultaneously during the illumination time period.

In one or more embodiments, after the states of the liquid crystals corresponding to the first set of pixels completed changing and before a start of the illumination time period, states of liquid crystals corresponding to the second set of pixels are in transition.

In one or more embodiments, the liquid crystal display device further includes a controller coupled to the liquid crystal layer and the backlight unit. The controller may be configured to sequentially apply a liquid crystal control signal to pixels of the liquid crystal layer per row during a data scan out time period for configuring states of the plurality of liquid crystals, and apply a backlight control signal to a light source coupled to the backlight unit to project the light towards the entire pixel area of the liquid crystal layer during the illumination time period simultaneously.

In one or more embodiments, the data scan out time period is determined based on (i) a data bandwidth used for transferring data from the controller to pixels in a row and (ii) a total number of rows of the plurality of pixels, and wherein the illumination time period is a remainder of the frame time excluding the data scan out time period and a liquid crystal transition time period during which states of liquid crystals in the row are changed.

In one or more embodiments, the data scan out time period is less than 1 ms, the illumination time period is 2 ms, and the frame time is less than 9 ms.

Disclosed embodiments include a method of displaying an image by a liquid crystal display device including a liquid crystal layer and a backlight unit coupled to the liquid crystal layer. The liquid crystal layer includes a plurality of liquid crystals in a pixel area, where a plurality of pixels are disposed in the pixel area. The method includes sequentially configuring states of the liquid crystals per row during a data scan out time period, and projecting, by the backlight unit, light towards the entire pixel area of the liquid crystal layer during an illumination time period of a frame time. The backlight unit does not project the light towards any of the pixel area of the liquid crystal layer during a non-illumination time period of the frame time.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

System Overview

Disclosed is an LCD including an LC layer and a BLU, which operate together in a global illumination (GI) mode. In the GI mode, the BLU is illuminated during a portion of a frame time (e.g., 20%) for displaying an image frame, and projects light towards entire pixels of the LC layer. The BLU may be turned off during a remaining portion of the frame time.

In one aspect, the frame time in the GI mode is segmented into three distinct time periods: a data scan out time period, a LC state change time period, and an illumination time period. A frame time herein refers to time duration between two image frames. During the data scan out time period, data scan out of pixels of the LC layer is performed. Data scan out (also referred to as data read out) includes charging the pixels according to voltages corresponding to image data. During the LC state change time period, states of the LCs are changed according to the charged voltages. During the illumination time period, the BLU emits light towards the LC layer. The BLU may be turned off during the data scan out time period and the LC state change time period.

In one application, a liquid crystal display disclosed herein can be implemented in a VR/AR system. In a VR/AR system, a user wears a head mounted display that presents an image of a VR/AR to the user, according to a physical movement of the user. For example, if a user turns his head to the left, a corresponding image of the virtual image is presented to the user, according to the user motion. However, generating the image according to the user movement involves complex processing that is accompanied by a delay between the user movement and the image presented. In case the user moves faster than the delay associated with presenting the image according to the user movement, the user may perceive a feeling of "lag" or a noticeable delay between the user movement and the image presented. By implementing the disclosed liquid crystal display with a short illumination time, high quality images (e.g., 1080 by 720 pixels or higher) of the VR/AR can be presented to the user without a noticeable lag.

Figure 1:
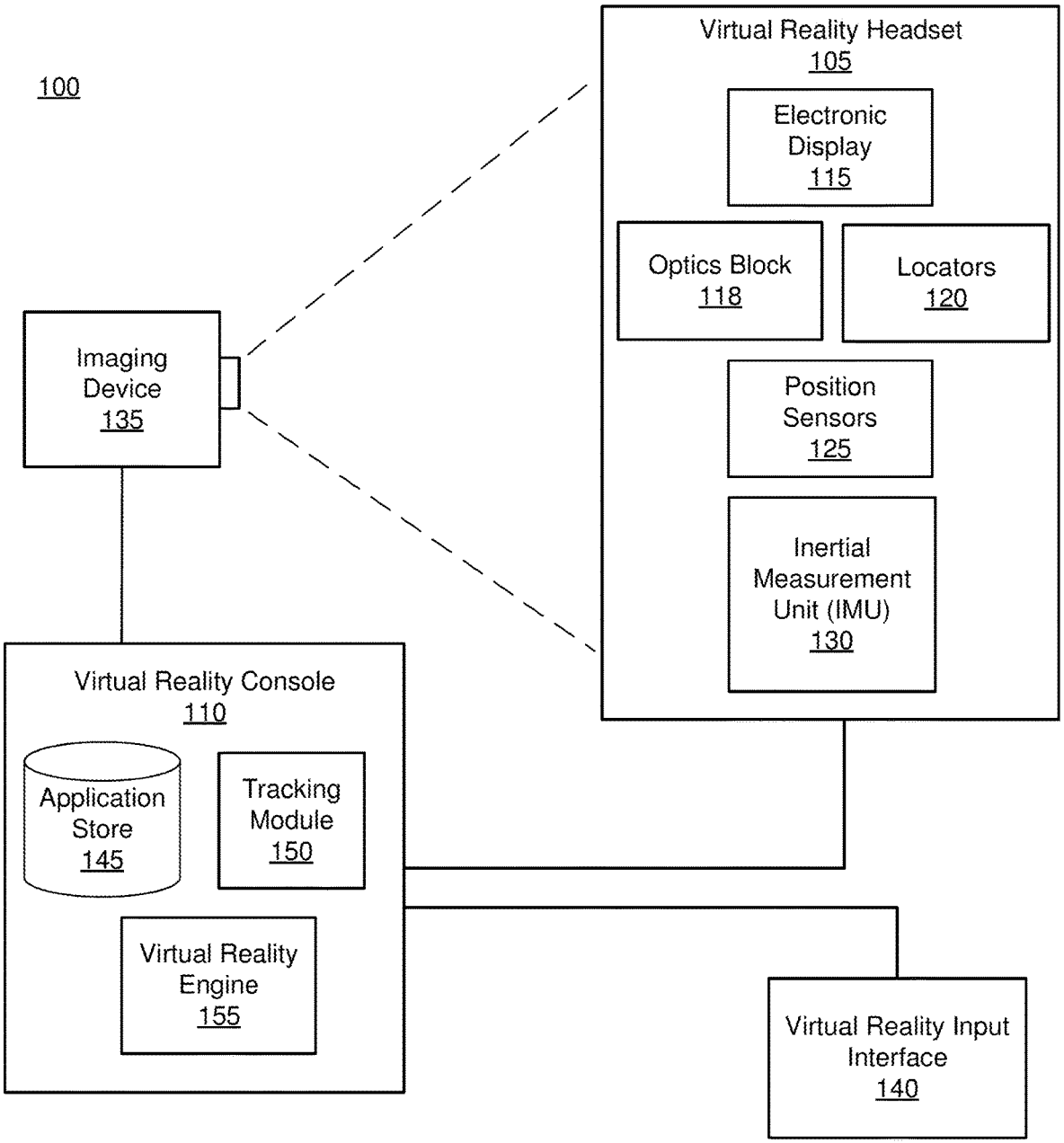
FIG. 1 is a block diagram of a system environment including a virtual reality system, in accordance with an embodiment.

FIG. 1 is a block diagram of a virtual reality (VR) system 100 in which a VR console 110 operates. The system 100 shown by FIG. 1 comprises a VR headset 105, an imaging device 135, and a VR input interface 140 that are each coupled to the VR console 110. While FIG. 1 shows an example system 100 including one VR headset 105, one imaging device 135, and one VR input interface 140, in other embodiments any number of these components may be included in the system 100. For example, there may be multiple VR headsets 105 each having an associated VR input interface 140 and being monitored by one or more imaging devices 135, with each VR headset 105, VR input interface 140, and imaging devices 135 communicating with the VR console 110. In alternative configurations, different and/or additional components may be included in the system 100. In some embodiments, the VR system 100 may also provide AR experience to a user.

The VR headset 105 is a head-mounted display that presents media to a user. Examples of media presented by the VR head set include one or more images, video, audio, or some combination thereof. In some embodiments, audio is presented via an external device (e.g., speakers and/or headphones) that receives audio information from the VR headset 105, the VR console 110, or both, and presents audio data based on the audio information. An embodiment of the VR headset 105 is further described below in conjunction with FIGS. 2A and 2B. The VR headset 105 may comprise one or more rigid bodies, which may be rigidly or non-rigidly coupled to each other together. A rigid coupling between rigid bodies causes the coupled rigid bodies to act as a single rigid entity. In contrast, a non-rigid coupling between rigid bodies allows the rigid bodies to move relative to each other.

The VR headset 105 includes an electronic display 115, an optics block 118, one or more locators 120, one or more position sensors 125, and an inertial measurement unit (IMU) 130. The electronic display 115 displays images to the user in accordance with data received from the VR console 110. In various embodiments, the electronic display 115 may comprise a single electronic display or multiple electronic displays (e.g., an electronic display for each eye of a user).

An electronic display 115 may be a liquid crystal display (LCD), or some combination of the LCD with another type of display (e.g., organic light emitting diode display).

The optics block 118 magnifies received light from the electronic display 115, corrects optical errors associated with the image light, and the corrected image light is presented to a user of the VR headset 105. An optical element may be an aperture, a Fresnel lens, a convex lens, a concave lens, a filter, or any other suitable optical element that affects the image light emitted from the electronic display 115. Moreover, the optics block 118 may include combinations of different optical elements. In some embodiments, one or more of the optical elements in the optics block 118 may have one or more coatings, such as anti-reflective coatings.

Magnification of the image light by the optics block 118 allows the electronic display 115 to be physically smaller, weigh less, and consume less power than larger displays. Additionally, magnification may increase a field of view of the displayed media. For example, the field of view of the displayed media is such that the displayed media is presented using almost all (e.g., 110 degrees diagonal), and in some cases all, of the user's field of view. In some embodiments, the optics block 118 is designed so its effective focal length is larger than the spacing to the electronic display 115, which magnifies the image light projected by the electronic display 115. Additionally, in some embodiments, the amount of magnification may be adjusted by adding or removing optical elements.

The optics block 118 may be designed to correct one or more types of optical error. Examples of optical error include: two dimensional optical errors, three dimensional optical errors, or some combination thereof. Two dimensional errors are optical aberrations that occur in two dimensions. Example types of two dimensional errors include: barrel distortion, pincushion distortion, longitudinal chromatic aberration, transverse chromatic aberration, or any other type of two-dimensional optical error. Three dimensional errors are optical errors that occur in three dimensions. Example types of three dimensional errors include spherical aberration, comatic aberration, field curvature, astigmatism, or any other type of three-dimensional optical error. In some embodiments, content provided to the electronic display 115 for display is pre-distorted, and the optics block 118 corrects the distortion when it receives image light from the electronic display 115 generated based on the content.

The locators 120 are objects located in specific positions on the VR headset 105 relative to one another and relative to a specific reference point on the VR headset 105. A locator 120 may be a light emitting diode (LED), a corner cube reflector, a reflective marker, a type of light source that contrasts with an environment in which the VR headset 105 operates, or some combination thereof. In embodiments where the locators 120 are active (i.e., an LED or other type of light emitting device), the locators 120 may emit light in the visible band (~380 nm to 750 nm), in the infrared (IR) band (~750 nm to 1 mm), in the ultraviolet band (10 nm to 380 nm), some other portion of the electromagnetic spectrum, or some combination thereof.

In some embodiments, the locators 120 are located beneath an outer surface of the VR headset 105, which is transparent to the wavelengths of light emitted or reflected by the locators 120 or is thin enough not to substantially attenuate the wavelengths of light emitted or reflected by the locators 120. Additionally, in some embodiments, the outer surface or other portions of the VR headset 105 are opaque in the visible band of wavelengths of light. Thus, the locators 120 may emit light in the IR band under an outer surface that is transparent in the IR band but opaque in the visible band.

The IMU 130 is an electronic device that generates fast calibration data based on measurement signals received from one or more of the position sensors 125. A position sensor 125 generates one or more measurement signals in response to motion of the VR headset 105. Examples of position sensors 125 include: one or more accelerometers, one or more gyroscopes, one or more magnetometers, another suitable type of sensor that detects motion, a type of sensor used for error correction of the IMU 130, or some combination thereof. The position sensors 125 may be located external to the IMU 130, internal to the IMU 130, or some combination thereof.

Based on the one or more measurement signals from one or more position sensors 125, the IMU 130 generates fast calibration data indicating an estimated position of the VR headset 105 relative to an initial position of the VR headset 105. For example, the position sensors 125 include multiple accelerometers to measure translational motion (forward/back, up/down, left/right) and multiple gyroscopes to measure rotational motion (e.g., pitch, yaw, roll). In some embodiments, the IMU 130 rapidly samples the measurement signals and calculates the estimated position of the VR headset 105 from the sampled data. For example, the IMU 130 integrates the measurement signals received from the accelerometers over time to estimate a velocity vector and integrates the velocity vector over time to determine an estimated position of a reference point on the VR headset 105. Alternatively, the IMU 130 provides the sampled measurement signals to the VR console 110, which determines the fast calibration data. The reference point is a point that may be used to describe the position of the VR headset 105. While the reference point may generally be defined as a point in space; however, in practice the reference point is defined as a point within the VR headset 105 (e.g., a center of the IMU 130).

The IMU 130 receives one or more calibration parameters from the VR console 110. As further discussed below, the one or more calibration parameters are used to maintain tracking of the VR headset 105. Based on a received calibration parameter, the IMU 130 may adjust one or more IMU parameters (e.g., sample rate). In some embodiments, certain calibration parameters cause the IMU 130 to update an initial position of the reference point so it corresponds to a next calibrated position of the reference point. Updating the initial position of the reference point as the next calibrated position of the reference point helps reduce accumulated error associated with the determined estimated position. The accumulated error, also referred to as drift error, causes the estimated position of the reference point to "drift" away from the actual position of the reference point over time.

The imaging device 135 generates slow calibration data in accordance with calibration parameters received from the VR console 110. Slow calibration data includes one or more images showing observed positions of the locators 120 that are detectable by the imaging device 135. The imaging device 135 may include one or more cameras, one or more video cameras, any other device capable of capturing images including one or more of the locators 120, or some combination thereof. Additionally, the imaging device 135 may include one or more filters (e.g., used to increase signal to noise ratio). The imaging device 135 is configured to detect light emitted or reflected from locators 120 in a field of view of the imaging device 135. In embodiments where the locators 120 include passive elements (e.g., a retroreflector), the imaging device 135 may include a light source that illuminates some or all of the locators 120, which retroreflect the light towards the light source in the imaging device 135. Slow calibration data is communicated from the imaging device 135 to the VR console 110, and the imaging device 135 receives one or more calibration parameters from the VR console 110 to adjust one or more imaging parameters (e.g., focal length, focus, frame rate, ISO, sensor temperature, shutter speed, aperture, etc.).

The VR input interface 140 is a device that allows a user to send action requests to the VR console 110. An action request is a request to perform a particular action. For example, an action request may be to start or end an application or to perform a particular action within the application. The VR input interface 140 may include one or more input devices. Example input devices include: a keyboard, a mouse, a game controller, or any other suitable device for receiving action requests and communicating the received action requests to the VR console 110. An action request received by the VR input interface 140 is communicated to the VR console 110, which performs an action corresponding to the action request. In some embodiments, the VR input interface 140 may provide haptic feedback to the user in accordance with instructions received from the VR console 110. For example, haptic feedback is provided when an action request is received, or the VR console 110 communicates instructions to the VR input interface 140 causing the VR input interface 140 to generate haptic feedback when the VR console 110 performs an action.

The VR console 110 provides media to the VR headset 105 for presentation to the user in accordance with information received from one or more of: the imaging device 135, the VR headset 105, and the VR input interface 140. In the example shown in FIG. 1, the VR console 110 includes an application store 145, a tracking module 150, and a virtual reality (VR) engine 155. Some embodiments of the VR console 110 have different modules than those described in conjunction with FIG. 1. Similarly, the functions further described below may be distributed among components of the VR console 110 in a different manner than is described here.

The application store 145 stores one or more applications for execution by the VR console 110. An application is a group of instructions, that when executed by a processor, generates content for presentation to the user. Content generated by an application may be in response to inputs received from the user via movement of the VR headset 105 or the VR interface device 140. Examples of applications include: gaming applications, conferencing applications, video playback application, or other suitable applications.

The tracking module 150 calibrates the VR system 100 using one or more calibration parameters and may adjust one or more calibration parameters to reduce error in determination of the position of the VR headset 105. For example, the tracking module 150 adjusts the focus of the imaging device 135 to obtain a more accurate position for observed locators on the VR headset 105. Moreover, calibration performed by the tracking module 150 also accounts for information received from the IMU 130. Additionally, if tracking of the VR headset 105 is lost (e.g., the imaging device 135 loses line of sight of at least a threshold number of the locators 120), the tracking module 150 re-calibrates some or all of the system 100.

The tracking module 150 tracks movements of the VR headset 105 using slow calibration information from the imaging device 135. The tracking module 150 determines positions of a reference point of the VR headset 105 using observed locators from the slow calibration information and a model of the VR headset 105. The tracking module 150 also determines positions of a reference point of the VR headset 105 using position information from the fast calibration information. Additionally, in some embodiments, the tracking module 150 may use portions of the fast calibration information, the slow calibration information, or some combination thereof, to predict a future location of the headset 105. The tracking module 150 provides the estimated or predicted future position of the VR headset 105 to the VR engine 155.

The VR engine 155 executes applications within the system 100 and receives position information, acceleration information, velocity information, predicted future positions, or some combination thereof of the VR headset 105 from the tracking module 150. Based on the received information, the VR engine 155 determines content to provide to the VR headset 105 for presentation to the user. For example, if the received information indicates that the user has looked to the left, the VR engine 155 generates content for the VR headset 105 that mirrors the user's movement in a virtual environment. Additionally, the VR engine 155 performs an action within an application executing on the VR console 110 in response to an action request received from the VR input interface 140 and provides feedback to the user that the action was performed. The provided feedback may be visual or audible feedback via the VR headset 105 or haptic feedback via the VR input interface 140.

Figure 2A:
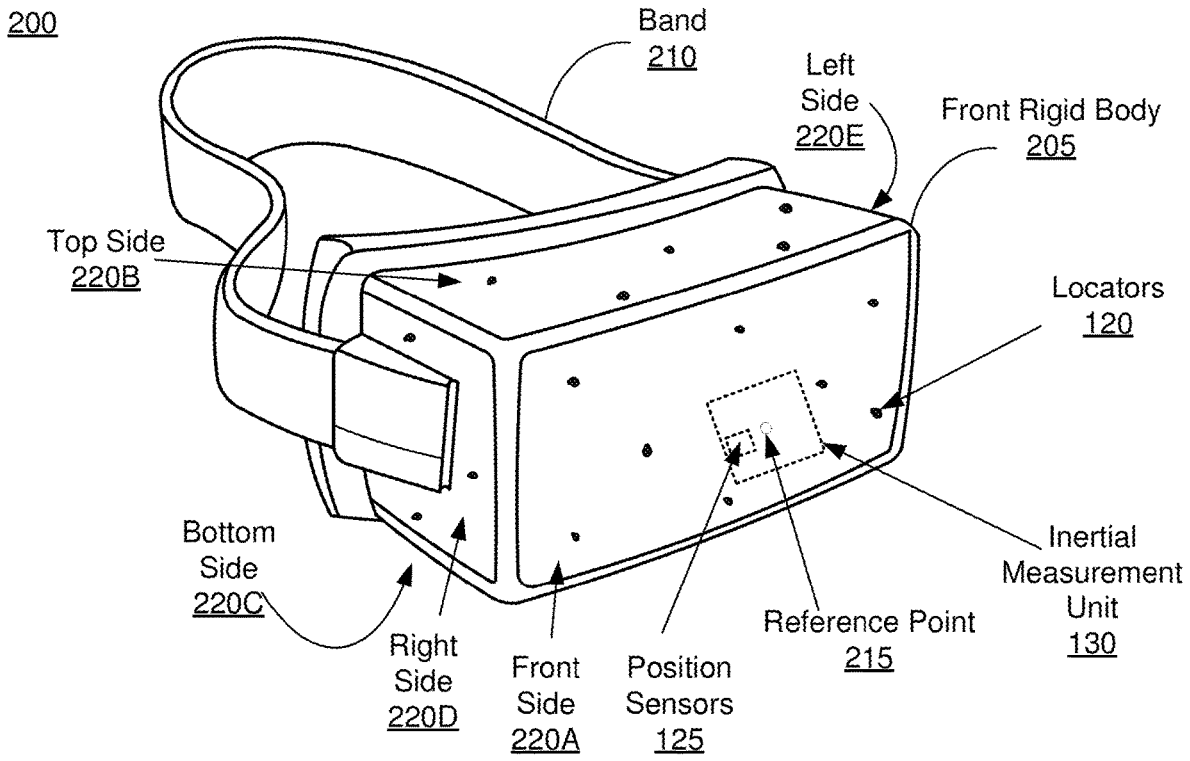
FIG. 2A is a diagram of a virtual reality headset, in accordance with an embodiment.

FIG. 2A is a diagram of a virtual reality (VR) headset, in accordance with an embodiment. The VR headset 200 is an embodiment of the VR headset 105, and includes a front rigid body 205 and a band 210. The front rigid body 205 includes an electronic display 115, the IMU 130, the one or more position sensors 125, and the locators 120. In the embodiment shown by FIG. 2A, the position sensors 125 are located within the IMU 130, and neither the IMU 130 nor the position sensors 125 are visible to the user.

The locators 120 are located in fixed positions on the front rigid body 205 relative to one another and relative to a reference point 215. In the example of FIG. 2A, the reference point 215 is located at the center of the IMU 130. Each of the locators 120 emit light that is detectable by the imaging device 135. Locators 120, or portions of locators 120, are located on a front side 220A, a top side 220B, a bottom side 220C, a right side 220D, and a left side 220E of the front rigid body 205 in the example of FIG. 2A.

Figure 2B:
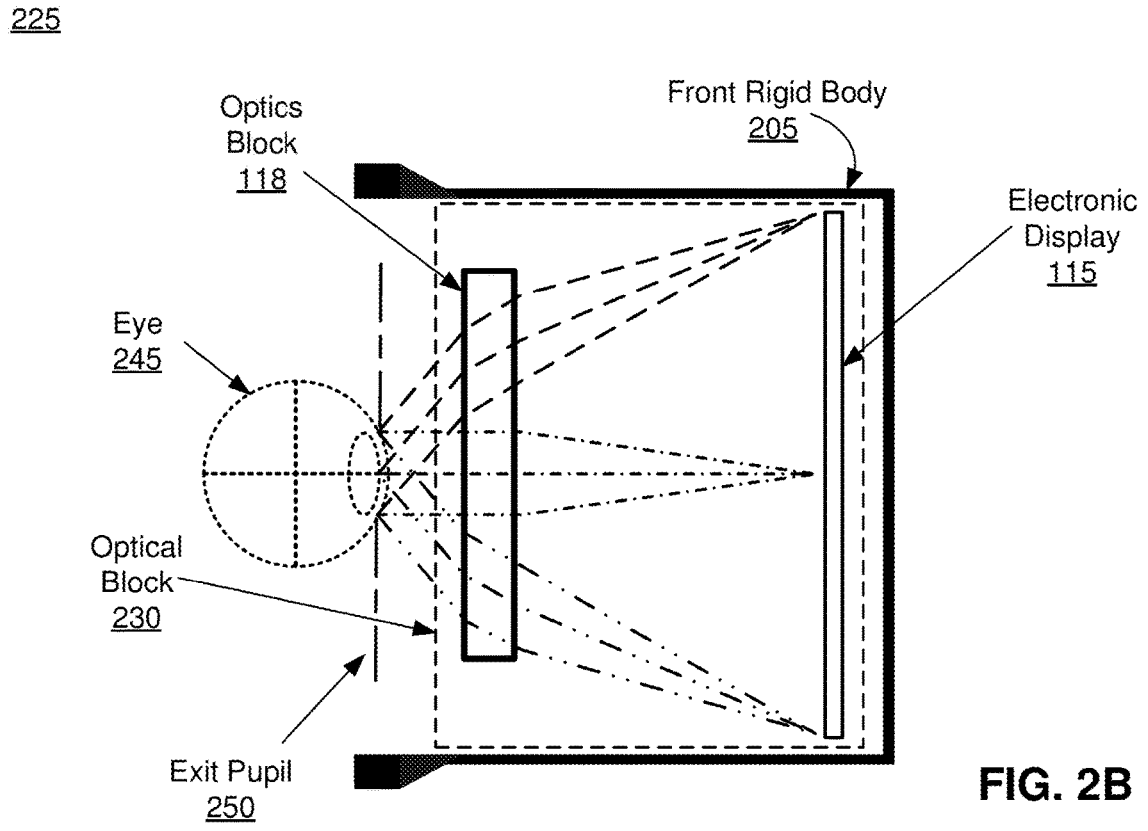
FIG. 2B is a cross section of a front rigid body of the VR headset in FIG. 2A, in accordance with an embodiment.

FIG. 2B is a cross section 225 of the front rigid body 205 of the embodiment of a VR headset 200 shown in FIG. 2A. As shown in FIG. 2B, the front rigid body 205 includes an optical block 230 that provides altered image light to an exit pupil 250. The exit pupil 250 is the location of the front rigid body 205 where a user's eye 245 is positioned. For purposes of illustration, FIG. 2B shows a cross section 225 associated with a single eye 245, but another optical block, separate from the optical block 230, provides altered image light to another eye of the user.

The optical block 230 includes an electronic display 115, and the optics block 118. The electronic display 115 emits image light toward the optics block 118. The optics block 118 magnifies the image light, and in some embodiments, also corrects for one or more additional optical errors (e.g., distortion, astigmatism, etc.). The optics block 118 directs the image light to the exit pupil 250 for presentation to the user.

Figure 3A:
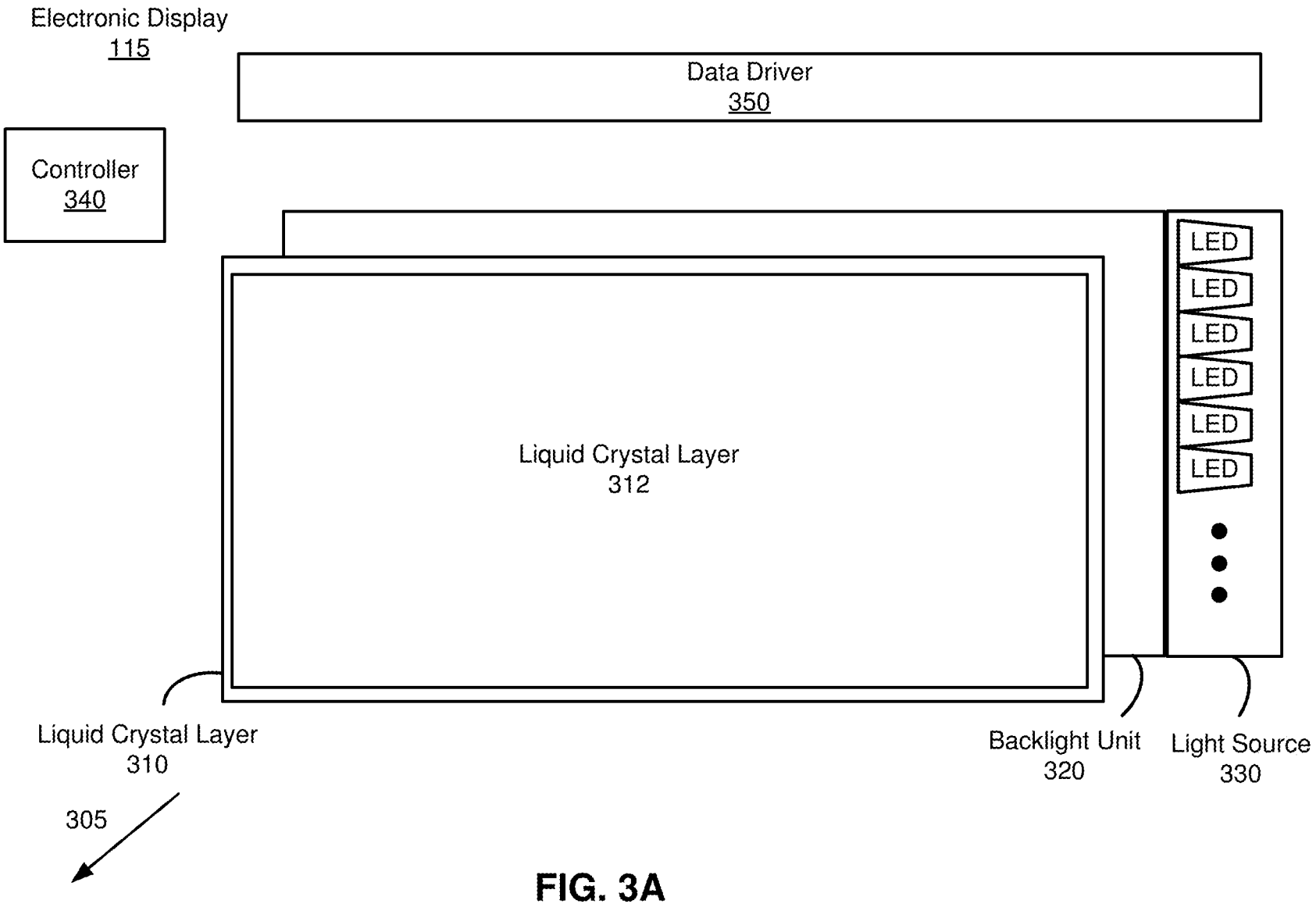
FIG. 3A is a perspective view of an example electronic display, in accordance with an embodiment.
Figure 3B:
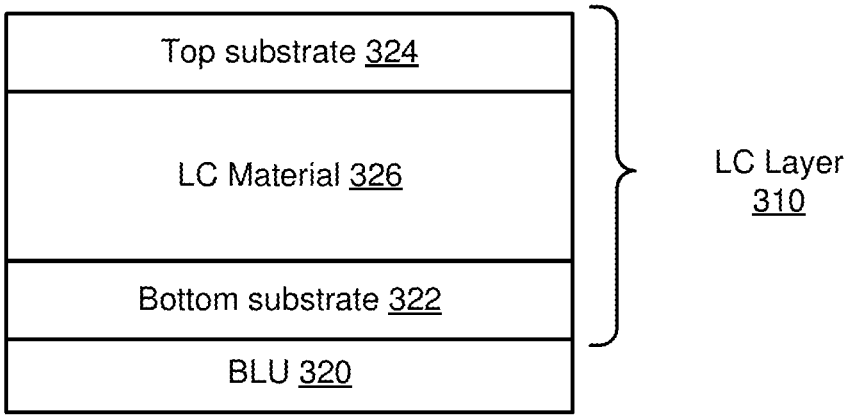
FIG. 3B is a cross section of an example electronic display, in accordance with an embodiment.

FIG. 3A is a perspective view of an electronic display 115, in accordance with an embodiment. FIG. 3B is a cross section view of the electronic display 115, in accordance with an embodiment. In one embodiment, the electronic display 115 is a LCD device including a LC layer 310, BLU 320, a data driver 350, and a controller 340. The LC layer 310 covers the BLU 320 and includes a pixel area 312. In the pixel area 312, a plurality of pixels are disposed in an array. A cross section of the pixel area 312 is shown in FIG. 3B and shows the LC layer 310 covering the BLU 320. In other embodiments, the electronic display 115 includes different, more or fewer components than shown in FIGS. 3A and 3B. For example, the electronic display 115 may include a polarizer and a light diffusing component.

In one embodiment, a light source 330 is an electrical component that generates light. The light source may comprise a plurality of light emitting components (e.g., light emitting diodes (LEDs), light bulbs, or other components for emitting light). In one aspect, intensity of light from the light source 330 is adjusted according to a backlight control signal from the controller 340. The backlight control signal is a signal indicative of intensity of light to be output for the light source 330. A light source may adjust its duty cycle of or an amount of current supplied to the light emitting component (e.g., LED), according to the backlight control signal. For example, the LEDs may be 'ON' for a portion of a frame time, and 'OFF' for another portion of the frame time, according to the backlight control signal. Example operations of the BLU 320 are further described in detail below with respect to FIGS. 4A and 4B.

The BLU 320 receives light from the light source 330, and projects the received light towards the liquid crystal layer 310. The BLU 320 may include a lightguide composed of a glass material or a transparent plastic material, and refractive and/or reflective components for projecting light towards the liquid crystal layer 310. The lightguide may receive light with different colors from light sources 330, and may project combined light including a combination of the different colors towards the liquid crystal layer 310.

The liquid crystal layer 310 includes a bottom substrate 322, a top substrate 324, and liquid crystal material 326, as shown in FIG. 3B. Although not shown in FIG. 3B, the bottom substrate 322 may include driver pixel circuitry and transparent pixel electrodes, and the top substrate 324 may include color filters, a black matrix, and transparent conductive electrodes. Also, spacers may be used to control the spacing between the top substrate and the bottom substrate, although not shown in FIG. 3B. The liquid crystal material 326 is placed between the top and bottom substrates 324, 322.

The data driver 350 is communicatively coupled to the liquid crystal layer 310 and the controller 340. The data driver 350 writes display data to pixels of the liquid crystal layer 310. Although shown as a separate component, the data driver 350 may be included in the liquid crystal layer 310. The display data written to a pixel may be in the form of an analog voltage that may be applied across electrodes on the bottom and/or top substrate 322 and 324 of a pixel to change the orientation of liquid crystal material 326 associated with the pixel. The change in orientation of the liquid crystal material 326 allows a portion of the light from the BLU 320 to reach a user's eye 245.

The controller 340 is a circuit component that receives an input image data and generates control signals for driving the data driver 350 and BLU 320. The input image data may correspond to an image or a frame of a video in a VR and/or AR application. The controller 340 instructs the data driver 350 to write data to the liquid crystal layer 310 to control an amount of light from the BLU 320 to the exit pupil 250 through the liquid crystal material 326. The controller 340 generates the backlight control signal for turning ON or OFF the BLU 320 (or the light source 330), as described in more detail with respect to FIGS. 4A and 4B.

Global Illumination Mode for LCDs in VR Headset

The electronic display 115 in a VR headset 200 operates with a predetermined duty cycle of the BLU 320 to enable the BLU for an illumination time period (e.g., 2 ms) less than a frame time (e.g., 9 ms). The switching time associated with the liquid crystal (LC), or the amount of time required for the LC to change state, may take several milliseconds (ms), making it difficult to achieve a short duty cycle with LCDs and thereby limiting the speed of LCDs. By enabling the BLU 320 for the illumination time period less than the frame time, image streaking and latency can be reduced. The electronic display 115 operates with the predetermined duty cycle in the GI mode as described in detail below.

In the GI mode, the BLU 320 turns on only after a frame of data is written (data scan out and charging of the pixels) and all the LCs in the LC layer 310 have completed state changes. In the GI mode, a frame time is segmented into three distinct time periods: a data scan out time period, a LC state change time period, and an illumination time period. The data scan out time period is for charging pixels in the LC layer 310 based on the image data, the LC state change time period is for changing the LC state according to the charged pixels, and the illumination time period is for illuminating the BLU.

In the GI mode, the BLU is turned on for only a portion of the frame time (e.g., last 20% of the frame) and illuminates the entire pixel area of the LC layer 310. Because the BLU is turned on for a portion of the frame time with the entire pixel area illuminated by virtue of all the pixels of the LCD being charged with their respective data voltages before the BLU is turned on, this mode is called global illumination mode.

Figure 4A:
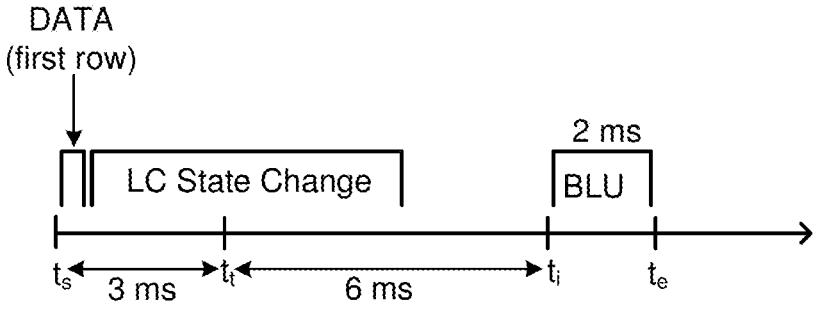
FIGS. 4A and 4B are diagrams illustrating a frame time of an LCD in global illumination mode, in accordance with an embodiment.
Figure 4B:
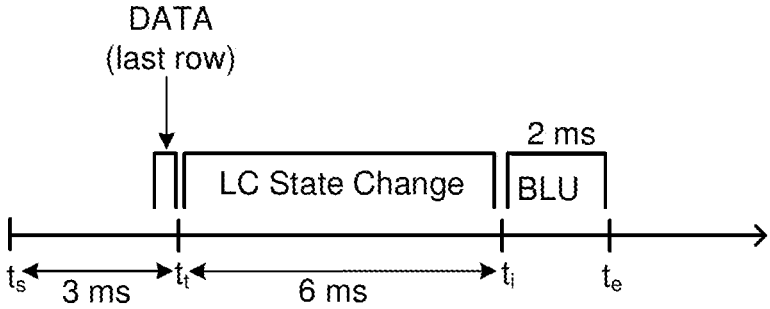

FIGS. 4A and 4B show an example frame time for a 90 Hz LCD in GI mode, according to one embodiment. In the example frame time shown in FIGS. 4A and 4B, a frame time for displaying an image frame begins at $t_s$ and ends at $t_e$. In one embodiment, the frame time between $t_s$ to $t_e$ is divided into three time periods: a data scan out time period between $t_s$ to $t_t$, an LC state change time period between $t_t$ to $t_i$, and an illumination time period between $t_i$ to $t_e$. During the data scan out time period between $t_s$ to $t_t$, the liquid crystal control signal for all the pixels are read out and all the pixels of the LCD are charged with their respective data voltages. During the LC state change time period between $t_t$ to $t_i$, states of liquid crystals change. During the illumination time period between $t_i$ and $t_e$, the BLU 320 may emit light towards the entire pixel area of the LC layer 310.

In one or more embodiments, data scan out and LC state changes are performed per row of pixels in the LC layer 310, whereas pixels in the entire rows of the LC layer 310 are illuminated simultaneously. In one approach, changing states of LCs corresponding to pixels in a row initiates as soon as data scan out of the pixels in the row is completed. For example, FIG. 4A shows the timing diagram corresponding to the first row of pixels of the LCD. As shown in FIG. 4A, data scan out of pixels in the first row is performed during a first portion (e.g., less than 1 ms) of the data scan out time period between $t_s$ to $t_t$. States of the LCs corresponding to the first row begin changing as soon as the data scan out of the first row is complete. FIG. 4B shows the timing diagram corresponding to the last row of pixels of the LCD. Data scan out of pixels in the last row is performed during a last portion of the data scan out time period between $t_s$ to $t_t$. States of the LCs corresponding to the last row begin changing as soon as the data scan out of the last row is complete. The data scan out of pixels in other rows occurs between the first portion and the last portion of the data scan out time period sequentially. That is, data scan out of pixels in a second row begins as soon as the data scan out of the pixels in the first row is complete, and data scan out of pixels in a third row begins as soon as the data scan out of the pixels in the second row is complete. Hence, states of LCs of pixels in one or more rows may be still in transition, when the data scan out of the last row is performed, as shown in FIG. 4B.

The illumination of the BLU is performed during the illumination time period between (i) $t_i$ (i.e., time at which pixel data of the whole frame is scanned out and their corresponding LCs have completed transitions), and (ii) $t_e$ (i.e., an end of the frame time). The BLU may be turned off during other portions (e.g., between $t_s$ and $t_i$) of the frame time, such that any of the LC layer 310 is not illuminated during said other portions of the frame time. Because the LC state change of pixels in the first row occurs before LC state change of other pixels in other rows, the LCs corresponding to pixels in the first row are not illuminated even after the states of the LCs are changed until the illumination time period begins.

In one aspect, the duty cycle of the BLU 320 (i.e., the illumination time period) is determined based on LC materials of the LC layer 310 and a data bandwidth of the host system (e.g., controller 340). Specifically, the LC transition time period is determined based on the speed of the LC material to ensure that LCs in pixels of a last row can be changed before the start of the illumination time period. The data scan out time period is determined based on (i) a data bandwidth used for transferring data from the host system (e.g., controller 340) to pixels in a row and (ii) a total number of rows. In one example, the data scan out time period may be determined as a multiple of a number of rows and an inverse of the data bandwidth. The illumination time period for the BLU is determined based on the remainder of frame time excluding the LC transition time period of the last row and the data scan out time period. For an example, a typical LC material in each row may take 6 ms to transition its state. Further assuming that the data scan out time is 3 ms for the entire rows and the frame time is 11 ms (i.e., ~90 Hz), the illumination time of the BLU is set to 2 ms. For a given BLU illumination time, data bandwidth requirements may be relaxed as the LC material speed improves with technology. Alternatively, a slower LC material may be used when a higher data bandwidth is used for data transfer for the given BLU illumination time.

Advantageously, the GI mode provides low image persistence as the BLU is turned on for only a small portion of the frame time (e.g., 20%). Illumination in the GI mode occurs only after the entire data is scanned and their corresponding LCs have completed transition to their final states, thereby avoiding any compromised pixels.

Additional Configuration Information

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A liquid crystal display device comprising:

a liquid crystal layer, including a plurality of liquid crystals in a pixel area, having a plurality of pixels disposed in the pixel area;

a backlight unit coupled to the liquid crystal layer, the backlight unit configured to project light towards the entire pixel area of the liquid crystal layer during an illumination time period of a frame time, and not to project light towards any of the pixel area of the liquid crystal layer during a non-illumination time period of the frame time; and a controller coupled to the liquid crystal layer and the backlight unit, configured to:

apply a liquid crystal control signal to one or more pixels of the liquid crystal layer during a data scan out time period for configuring states of the plurality of liquid crystals, wherein the data scan out time period does not overlap with the illumination time period, the data scan out time period is 1 ms or less, and the frame time is 9 ms or less.

2. The liquid crystal display device of claim 1, wherein:

the data scan out time period is a multiple of both (i) an inverse of a data bandwidth used for transferring data from the controller to pixels in a row and (ii) a total number of rows of the plurality of pixels, and wherein the illumination time period is a remainder of the frame time excluding the data scan out time period and a liquid crystal transition time period during which states of liquid crystals in the row are changed.

3. The liquid crystal display device of claim 1, wherein the controller is configured to apply the liquid crystal control signal to a first set of pixels of the plurality of pixels during a first portion of the non-illumination time period, and wherein states of liquid crystals corresponding to the first set of pixels are changed during a second portion of the non-illumination time period after the first portion of the non-illumination time period.

4. The liquid crystal display device of claim 3, wherein the controller is configured to apply the liquid crystal control signal to a second set of pixels of the plurality of pixels during a portion of the non-illumination time period overlapping with the second portion of the non-illumination time period.

5. The liquid crystal display device of claim 1, wherein the controller is further configured to:

sequentially apply the liquid crystal control signal to pixels of the liquid crystal layer per row during the data scan out time period, and apply a backlight control signal to a light source coupled to the backlight unit to project light from the backlight unit simultaneously towards the entire pixel area of the liquid crystal layer during the illumination time period.

6. The liquid crystal display device of claim 1, wherein the controller is further configured to generate a backlight control signal for controlling the backlight unit to project light towards the entire pixel area during the illumination time period, the backlight control signal specifying a duty cycle for controlling an intensity of light projected by the backlight unit.

7. The liquid crystal display device of claim 1, wherein the illumination time period is 2 ms.

8. A method of displaying an image by a liquid crystal display device including a liquid crystal layer and a backlight unit coupled to the liquid crystal layer, the liquid crystal layer including a plurality of liquid crystals in a pixel area, the pixel area having a plurality of pixels, the method comprising:

sequentially configuring states of the liquid crystals per row during a data scan out time period; and projecting, by the backlight unit, light towards the entire pixel area of the liquid crystal layer during an illumination time period of a frame time that does not overlap with the data scan out time period;

wherein the backlight unit does not project light towards any of the pixel area of the liquid crystal layer during a non-illumination time period of the frame time, the data scan out time period is 1 ms or less, and the frame time is 9 ms or less.

9. The method of claim 8, wherein:

the data scan out time period is a multiple of both (i) an inverse of a data bandwidth used for transferring data from the controller to pixels in a row and (ii) a total number of rows of the plurality of pixels, and wherein the illumination time period is a remainder of the frame time excluding the data scan out time period and a liquid crystal transition time period during which states of liquid crystals in the row are changed.

10. The method of claim 8, wherein a first set of pixels of the plurality of pixels is applied with the liquid crystal control signal during a first portion of the non-illumination time period, and wherein states of liquid crystals corresponding to the first set of pixels are changed during a second portion of the non-illumination time period after the first portion of the non-illumination time period.

11. The method of claim 10, wherein a second set of pixels of the plurality of pixels is applied with the liquid crystal control signal during a portion of the non-illumination time period overlapping with the second portion of the non-illumination time period.

12. The method of claim 8, wherein the backlight control unit projects light based upon a backlight control signal, the backlight control signal specifying a duty cycle for controlling an intensity of light projected by the backlight unit.

13. The method of claim 8, wherein the illumination time period is 2 ms.

14. A liquid crystal display device comprising:

a liquid crystal layer including a plurality of liquid crystals in a pixel area, having a plurality of pixels disposed in the pixel area;

a backlight unit coupled to the liquid crystal layer, the backlight unit configured to project light towards the entire pixel area of the liquid crystal layer during an illumination time period of a frame time, and not to project light towards any of the pixel area of the liquid crystal layer during a non-illumination time period of the frame time; and a controller coupled to the liquid crystal layer and the backlight unit, configured to:

apply a liquid crystal control signal to one or more pixels of the liquid crystal layer during a data scan out time period for configuring states of the plurality of liquid crystals, wherein the data scan out time period does not overlap with the illumination time period, the data scan out time period is 1 ms or less, and the frame time is 11 ms or less.

15. The liquid crystal display device of claim 14, wherein the frame time is 9 ms or less.

16. The liquid crystal display device of claim 14, wherein:

the data scan out time period is configured to be a multiple of both (i) an inverse of a data bandwidth used for transferring data from the controller to pixels in a row and (ii) a total number of rows of the plurality of pixels, and wherein the illumination time period is a remainder of the frame time excluding the data scan out time period and a liquid crystal transition time period during which states of liquid crystals in the row are changed.

17. The liquid crystal display device of claim 14, wherein the controller is configured to apply the liquid crystal control signal to a first set of pixels of the plurality of pixels during a first portion of the non-illumination time period, and wherein states of liquid crystals corresponding to the first set of pixels are changed during a second portion of the non-illumination time period after the first portion of the non-illumination time period.

18. The liquid crystal display device of claim 14, wherein the controller is further configured to:

sequentially apply the liquid crystal control signal to pixels of the liquid crystal layer per row during the data scan out time period, and apply a backlight control signal to a light source coupled to the backlight unit to project light from the backlight unit simultaneously towards the entire pixel area of the liquid crystal layer during the illumination time period.

19. The liquid crystal display device of claim 14, wherein the controller is further configured to generate a backlight control signal for controlling the backlight unit to project light towards the entire pixel area during the illumination time period, the backlight control signal specifying a duty cycle for controlling an intensity of light projected by the backlight unit.

20. The liquid crystal display device of claim 14, wherein the illumination time period is 2 ms.

* * * * *